US005300748A

United States Patent [19]

Colombo

[11] Patent Number: 5,300,748

[45] Date of Patent: Apr. 5, 1994

[54] RECYCLABLE MICROWAVABLE CONTAINER WITH A HINGED REMOVABLE OUTER SHELL

[75] Inventor: Edward A. Colombo, Penfield, N.Y.

[73] Assignee: Mobil Oil Corporation, Fairfax, Va.

[21] Appl. No.: 919,797

[22] Filed: Jul. 27, 1992

Related U.S. Application Data

[63] Continuation-in-part of Ser. No. 690,189, Aug. 27, 1987, Pat. No. 4,870,396.

[51] Int. Cl.[5] ..... H05B 6/80

[52] U.S. Cl. ..... 219/734; 99/DIG. 14; 426/234; 220/339; 220/410; 229/903

[58] Field of Search ..... 219/10.55 E; 99/DIG. 14; 426/107, 109, 234; 220/339, 409, 410; 229/902, 903

[56] References Cited

U.S. PATENT DOCUMENTS

| | | | |
|---|---|---|---|
| 3,552,595 | 1/1971 | Gerner et al. | 220/339 |
| 3,933,296 | 1/1976 | Ruskin et al. | 220/339 |
| 4,183,435 | 1/1980 | Thompson et al. . | |
| 4,439,656 | 3/1984 | Peleg . | |
| 4,478,349 | 10/1984 | Haverland, Jr. et al. . | |
| 4,505,404 | 3/1985 | Perchak et al. | 220/339 |
| 4,661,672 | 4/1987 | Nakanaga . | |
| 4,703,149 | 10/1987 | Sugisawa et al. . | |
| 4,704,510 | 11/1987 | Matsui . | |
| 4,756,446 | 7/1988 | Gen et al. . | |
| 4,795,649 | 1/1989 | Kearns et al. . | |
| 4,801,017 | 1/1989 | Artusi . | |
| 4,847,459 | 7/1989 | Desai . | |
| 4,916,280 | 4/1990 | Havette . | |
| 4,994,638 | 2/1991 | Irons et al. . | |

FOREIGN PATENT DOCUMENTS

| | | | |
|---|---|---|---|
| 60-84519 | 11/1985 | Japan . | |
| 4-6035 | 1/1992 | Japan | 220/339 |

*Primary Examiner*—Philip H. Leung
*Attorney, Agent, or Firm*—Alexander J. McKillop; George W. Hager, Jr.

[57] ABSTRACT

A microwavable container useful in the microwave heating of items, particularly foodstuffs, comprises readily separable components. An outer shell which will remain relatively cool and, therefore, capable of being handled, is flexibly hinged to an inner shell capable of sustaining high temperatures. The inner shell rotatably folds about the flexible hinge in such a way that it is arranged in a substantially spaced relation to the outer shell and is releasably secured to the outer shell. The outer shell is made of a first microwavable polymeric material. The inner shell is made of a second microwavable polymeric material which is different from the first microwavable polymeric material. A consumer may heat a food product in the inner shell of the present invention without risking contact with that inner shell when the inner shell becomes hot. After use, the components are readily separable for separate recycling processes.

19 Claims, 3 Drawing Sheets

RECYCLABLE MICROWAVABLE CONTAINER WITH A HINGED REMOVABLE OUTER SHELL

This application is a continuation-in-part of U.S. patent application Ser. No. 07/690,189, which was filed on Apr. 16, 1991, now U.S. Pat. No. 4,870,396.

The present invention is directed to a microwavable container and, more particularly, to a microwavable container having improved recyclability.

BACKGROUND OF THE INVENTION

Containers for microwavable materials, particularly foodstuffs, have enjoyed increased marketing demand in recent times. The basic requirements for a microwavable container include high temperature resistance and adequate stiffness at elevated temperatures. Additionally, the outer surface should remain sufficiently cool such that the container may be safely handled.

Since most polymers having the necessary stiffness typically become quite hot when in contact with a heated foodstuff, it has previously been suggested to provide containers formed of laminates having an outer, insulating layer. For example, it has previously been suggested that a microwavable food packaging container be formed as a laminate with a polyethylene terephthalate film laminated on the interior of a foamed polystyrene sheet. The foamed polystyrene sheet material provides good heat insulation allowing such containers to be safely handled after microwaving. It has also been suggested to laminate other insulators, such as cardboard, to polymers to provide a safe, cool outer protective layer to microwavable containers. Alternatively, the use of a container having a core layer of a foamed thermoplastic polymeric material such as high density polyethylene or polypropylene laminated to surface layers of polyethylene terephthalate or polypropylene has also been suggested.

A significant disadvantage of previously known microwavable containers such as those discussed above lies in the difficulty in recycling laminates of different materials. Since these materials inherently have different requirements for recycling, it is desirable to first separate the layers prior to recycling. Such separating is very difficult and costly, making it impractical on a commercial scale. It would, therefore, be very desirable to provide a microwavable container having the desirable properties referred to above and which has components which are readily separable for recycling.

Another disadvantage of previously known recyclable microwavable containers is the consumer's perception of overpackaging when a container is made up of multiple components. It would, therefore, be very desireable to provide a microwavable container which avoids the consumer's perception of multiple components while simultaneously providing components which are readily separable for recycling.

SUMMARY OF THE INVENTION

The present invention comprises a microwavable container useful in the microwave heating of items, particularly foodstuffs. The container of the present invention comprises readily separable components. An outer shell, made of a first polymeric material, which will remain relatively cool and therefore capable of being handled, is hinged to and advantageously supports an inner shell, made of second polymeric material, capable of sustaining high temperatures. The inner shell rotatably folds about the hinge in such a way that it is arranged in a substantially spaced relation to the outer shell and is releasably secured to the outer shell. A consumer may heat a food product in the inner shell of the present invention without risking contact with that inner shell when it becomes hot. After use, the components are readily separable for separate recycling processes.

DETAILED DESCRIPTION

The present invention advantageously provides a novel microwavable container which is inexpensive, easy to manufacture, has excellent microwaving properties, is particularly adapted for efficient recycling and avoids the consumer's perception of overpackaging.

According to one embodiment of the present invention, an outer shell is formed of a first polymer, such as polystyrene, which has good structural properties for supporting a food product and is readily formed into desired shapes. Hinged to and supported within the outer shell is an inner shell preferably formed of a second polymer having high heat resistance, such as a polyester or polypropylene. The inner shell rotatably folds about the hinge in such a way that the inner shell is arranged in a substantially spaced relation to the outer shell and is releasably secured to the outer shell. The inner shell is preferably disposed within the outer shell such that a gap exists between the respective walls of the inner and outer shells. Those skilled in the art will appreciate that during microwaving, a foodstuff placed in the inner shell may become very hot thereby raising the temperature of the inner shell. By minimizing the area of contact between the walls of the inner and outer shells, the transfer of heat to the outer shell will be greatly reduced. As stated above, it is very desirable to provide an outer shell made of a first polymeric material which does not become very hot during microwaving such that the entire container may be readily handled by a consumer even when that container is supporting a heated foodstuff.

The manner of maintaining a gap between the inner and outer shells may take different forms and need not eliminate all contact between these two components of the container of the present invention. According to one preferred embodiment of the present invention illustrated below, the inner shell is designed to contact the base of the outer shell at a limited number of points and only to contact the sidewalls of the outer shell near the top of the sidewalls.

Figure 2:
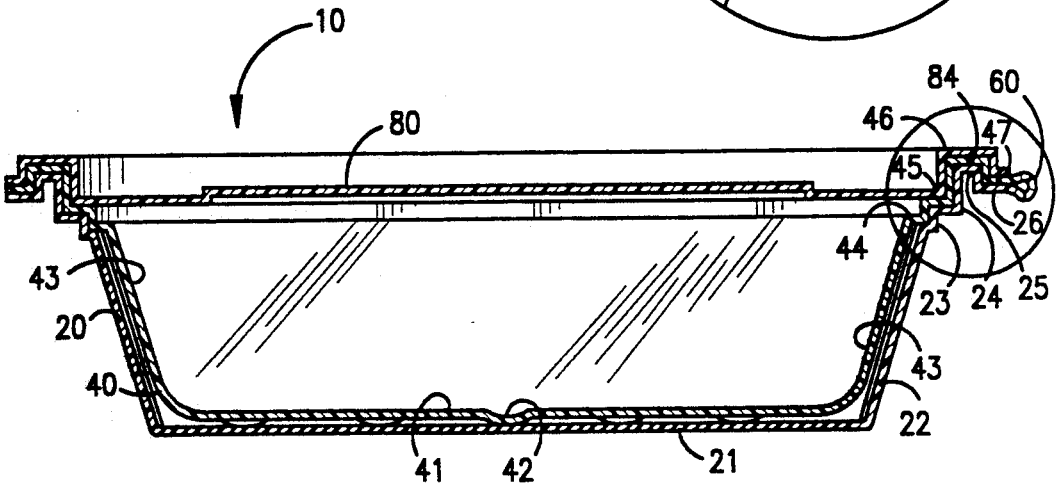
FIG. 2 is an exploded view of the container illustrated in FIG. 1.
Figure 3:
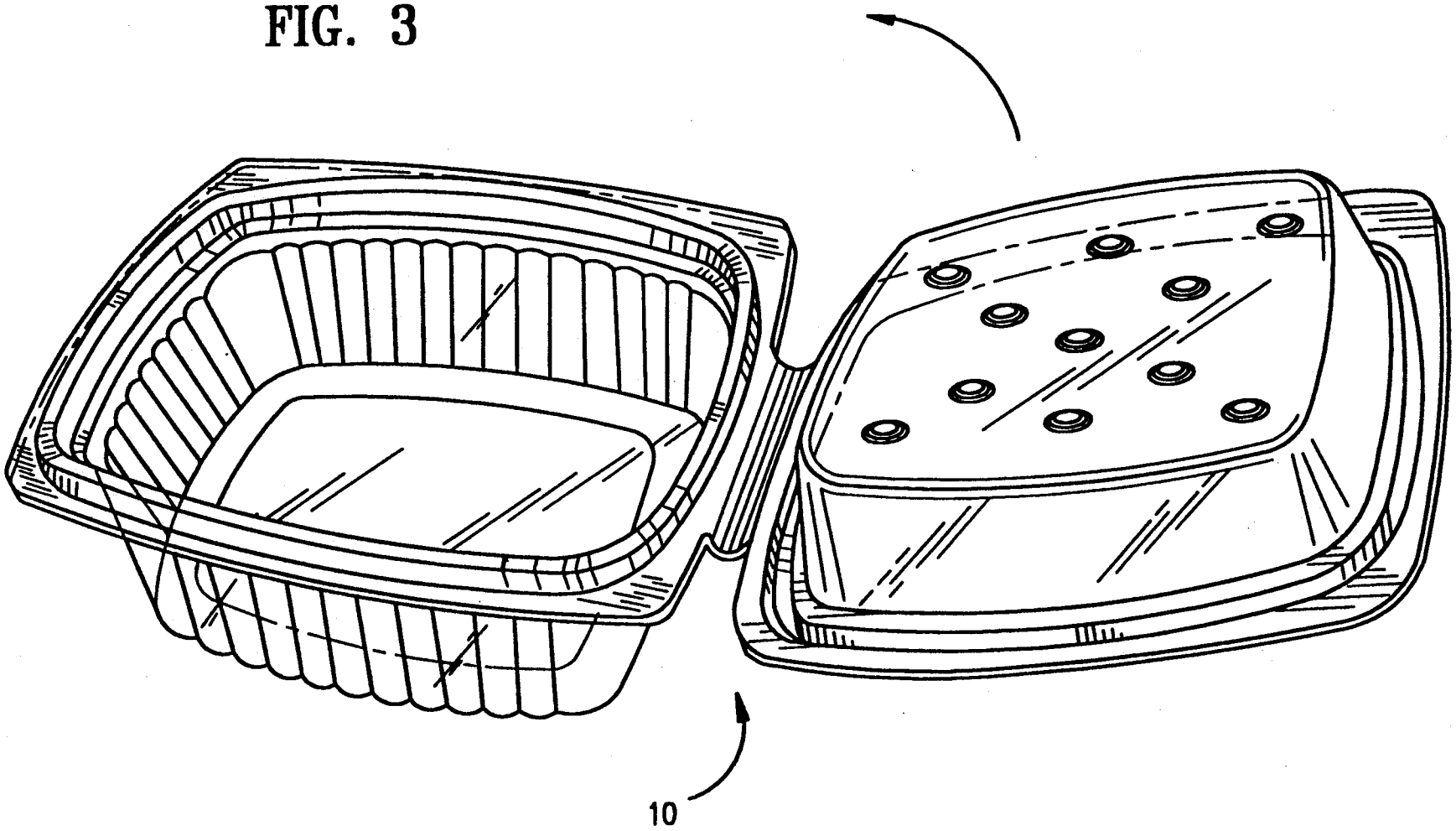
FIG. 3 is a view of the inner shell of the container rotated about the hinge.
Figure 5:
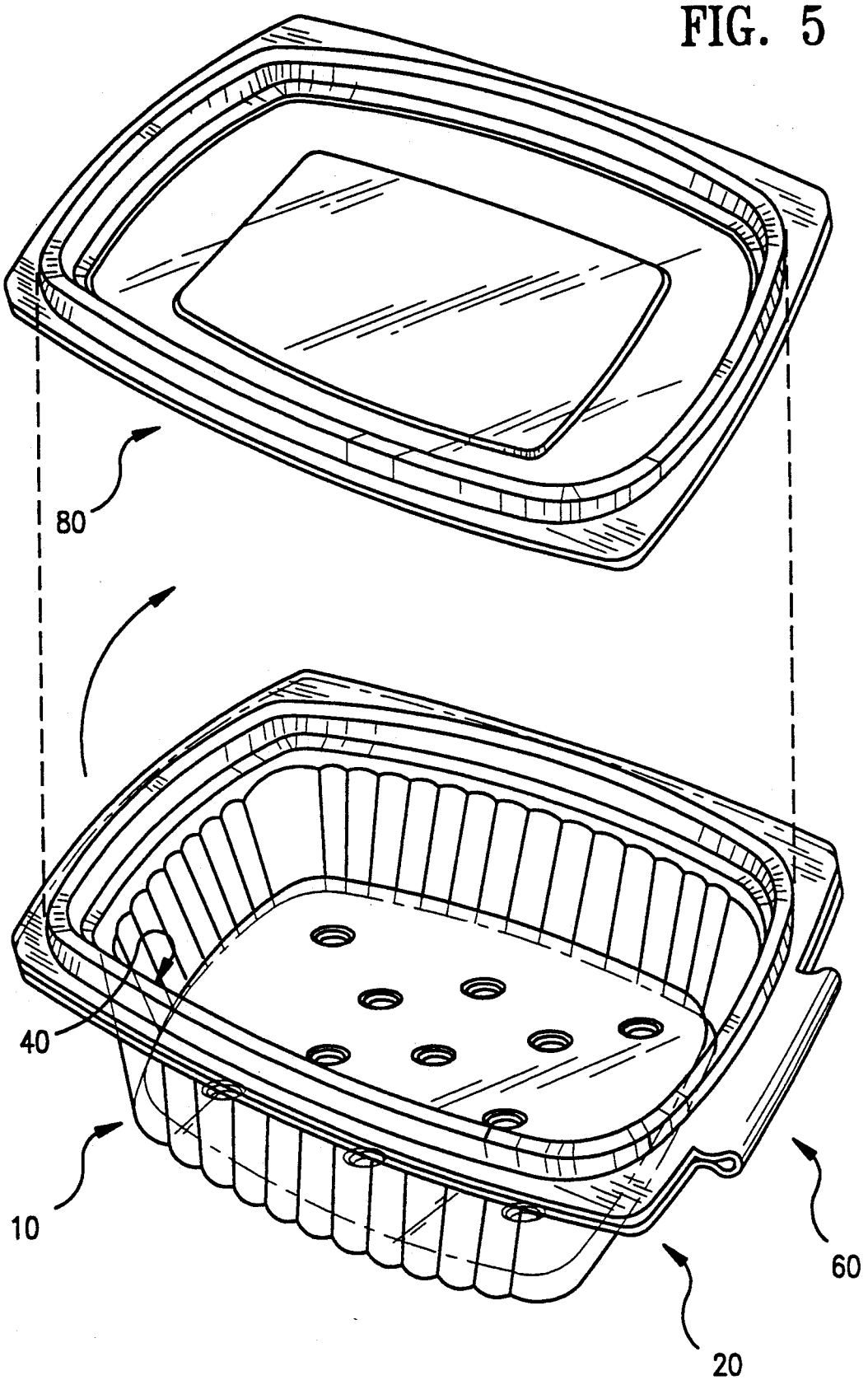
FIG. 5 is a prospective view of one embodiment of the present invention with the cover removed.

FIGS. 2 and 5 illustrate one preferred embodiment of the present invention wherein container 10 is formed of four components: an outer shell 20, an inner shell 40, a hinge 60 connecting outer shell 20 and inner shell 40 and a lid 80. These components are advantageously formed in a manner which permits quick assembly, either manually or mechanically, as well as rapid disassembly for separate cleaning and/or recycling operations.

For example, in a preferred embodiment in which the outer shell 20 and the inner shell 40 are produced from different polymeric materials the shells can be formed separately and the hinge member which is a living hinge which extends from a portion of the outer shelf of the outer shell can be heat sealed, by methods known to those skilled in the art, to the hinge portion which extends from the outer shelf of the inner shell. During the heat sealing procedure or other suitable procedure known to those skilled in the art which is used to connect the outer shell 20 and the inner shell 40 in the hinge region 60, the hinge 60 can be perforated for easy separation for recycling operations.

Alternatively, in an embodiment in which both the outer shell 20 and inner shell 40 are produced from the same polymeric material the hinged microwavable container may be produced in a thermoformer or other suitable device known to those skilled in the art.

In one embodiment of the present invention the hinge member is a living hinge formed by a continuous plastic member 60 which connects an outer shelf 26 of the outer shell portion to the outer shelf 47 of the inner shell portion along one edge thereof. This living hinge arrangement is depicted at FIG. 2. Advantageously, this configuration permits the manufacture of the hinged device in a continuous mold. This facilitates ease and efficiency of manufacturing.

In the illustrated embodiment, at least the outer shell 20 and li3d 80 are most preferably formed of a clear, translucent polymer in order to facilitate continuous inspection of the contained foodstuff. While the present invention is described herein as a container particularly adapted for foodstuffs, those skilled in the art will appreciate that the benefits of the present invention may be applicable for the microwaving of other products.

With particular reference to FIG. 2, the relationship of the four components is illustrated. According to this preferred embodiment of the present invention, outer shell 20 is formed of a first polymeric material having a base 21 and ribbed sidewalls 22 which extend upwardly and slightly outwardly from base 21. An outwardly extending lower flange 23, an upper flange 24 an upwardly extending rim 25 and then an outer shelf 26 are integrally formed with the sidewalls 22. In this illustrated embodiment of the present invention the outer shelf 26 is also provided in order to provide a closer, tighter seal between outer shell 20 and inner shell 40 in a manner described above. The middle section of the outer shelf 26 of the outer shell 20 extends, on one side, to form the hinge 60 which extends and is attached to the outer shelf 47 of the inner shell 40.

As stated above, outer shell 20 may be formed of any microwavable material which is rigid enough to support the weight of the foodstuff, such as polystyrene, especially oriented polystyrene, high-impact polystyrene, and blends thereof. If the manufacturer does not require a product that enables visibility of the foodstuff, a more economical foamed polystyrene may be utilized. Other suitable polymeric materials include high impact polystyrene, amorphous polyester, polyvinyl chloride, polyethylene, blends and copolymers thereof.

Inner shell 40, formed of a second polymeric material rotatably folds about the hinge 60 and is advantageously designed for placement within outer shell 20 in a manner which minimizes the contact between the respective bases and sidewalls of each of these shells. Inner shell 40 of the illustrated embodiment is formed with a base 41 having a limited number of dimples 42 or other supportive geometries. For example, base 41 may be provided with about ten spaced dimples 42 in order to provide broad structural support to the base 41 while minimizing the area of actual contact between these separate shells. Inner shell 40 also has sidewalls 43 which extend upwardly and slightly outwardly from inner shell base 41. Inner shell sidewalls 43 terminate in a lower flange 44 which extends horizontally a distance of about 0.1 inch. Lower flange 44, upper flange 45, an upwardly extending rim 46 and outer shelf 47 are integrally formed with sidewalls 43. As noted above the middle section of outer shelf 47 of the inner shell 40 extends, on one side, to form the hinge 60 which extends to and is connected to the hinge extending from the outer shelf 26 of the outer shell 20.

Inner shell 40 may be formed of any microwavable, heat resistant material. The inner shell is preferably formed of a crystallized polyester, polypropylene or copolymers thereof. Other suitable materials include styrene maleic anhydride, talc filled polypropylene, high melt strength polypropylene, high crystallinity polypropylene, polyphenylene oxide blended with high impact polystyrene, blends and copolymers thereof including foamed or solid sheets thereof. As used herein with respect to the inner shell, the term "heat resistant" indicates that the inner shell will maintain its structural integrity even when contacted by a foodstuff heated to a temperature of about 200°-250° F.

Figure 1:
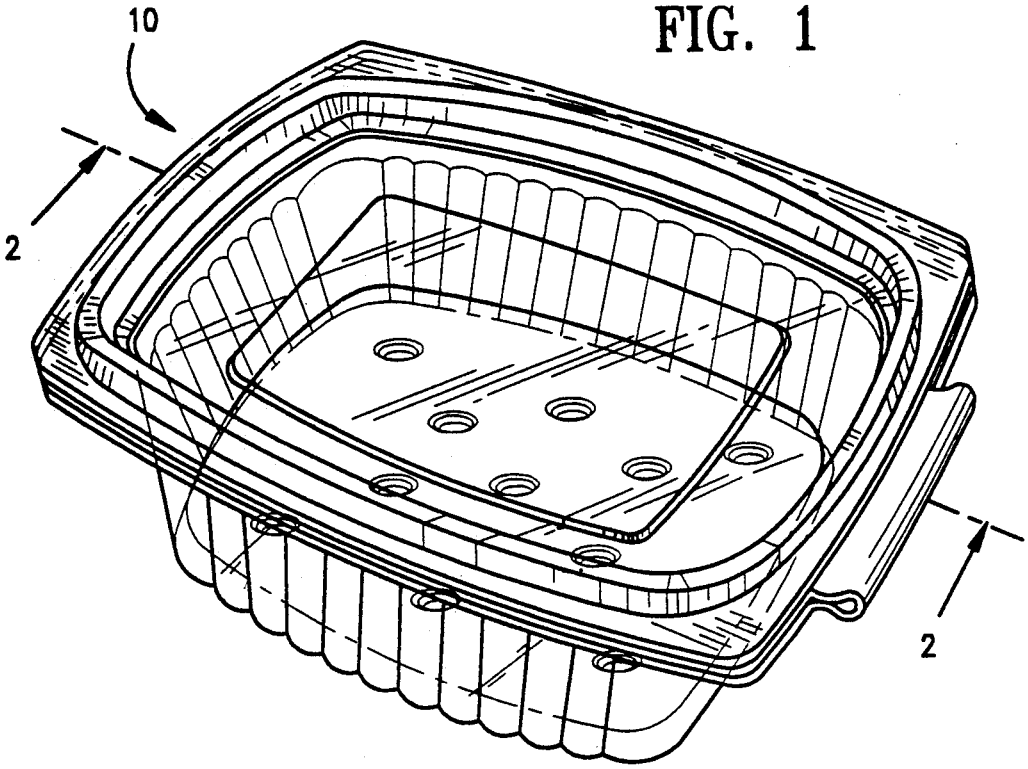
FIG. 1 is a perspective view of one embodiment of the present invention.
Figure 4:
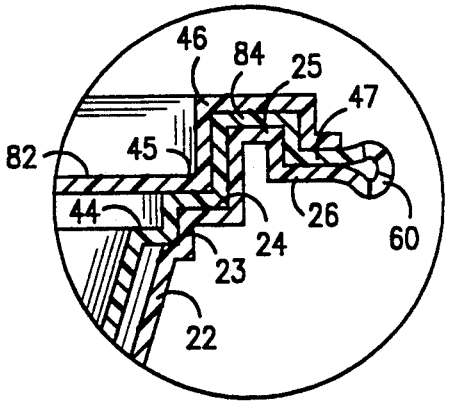
FIG. 4 is an enlarged view of the circled portion of FIG. 2.

The cooperative relationship between the upper rim sections of both the outer shell 20 and inner shell 40 are more clearly illustrated in the cross-sectional view of FIG. 2 and enlarged view of FIG. 4. In the manner illustrated, upper flange 45 of inner shell 40 is designed to rest upon upper flange 24 of outer shell 20. Furthermore, in order to provide additional support for the spaced relationship of the inner shell 40 with respect to outer shell 20, the bottom face of lower flange 44 is adapted to rest upon lower flange 23 of outer shell 20.

In order to releasably attach inner shell 40 to outer shell 20, the upper flange 24 of outer shell 20 is formed with an outer diameter slightly greater than the inner diameter defined by the inner wall of upwardly extending rim 25. This slight difference is designed to releasably accommodate upper flange 45 of inner shell 40 which may be snap-fit within rim 25 by a slight application of pressure to upper flange 45. In this fashion, inner shell 40 is releasably secured within outer shell 20. Thus, once inner shell 40 has been inserted into outer shell 20, the outer shell 20 may be inverted without displacing inner shell 40. However, when it is desired to separate inner shell 40 from outer shell 20, the application of upward pressure to the inner sidewalls 43 of inner shell 40 will be sufficient to disengage inner shell 40 from outer shell 20 due to the inherent resiliency of the materials used in forming these components. The illustrated embodiment of the present invention may be readily separated by hand. Those skilled in the art will appreciate that alternative arrangements for releasably attaching the inner shell and outer shell of the present invention may be utilized without departing from the present invention.

FIG. 2 also illustrates the spaced relationship between inner shell 40 and outer shell 20. As illustrated, the two shells only have actual contact at the positions of the several dimples 42 in the base 41 of inner shell 40 and in the upper regions of their respective sidewalls.

According to this illustrated preferred embodiment of the present invention, a lid 80 is also provided in order to protect a foodstuff placed within container 10 and to avoid splashing during the heating of the subject foodstuff. As illustrated, lid 80 is provided with an upwardly extending rim 84 shaped to complement upwardly extending rim 46 of inner shell 40. In the manner best illustrated in FIG. 4, the upper section of rim 46 is slightly wider than the rest of rim 46 thereby providing a seal with complementary shaped rim 84 of lid 80. Lid 80 also has a substantially planar central portion 82 whose outer edges are adapted to engage upper flange 45 of inner shell 40.

Lid 80 may be formed of any suitable microwavable material and is preferably formed of a clear, substantially rigid polymer such as those described above for use with outer shell 20.

While the dimensions and actual configuration of the components of the present invention may be readily selected in light of the present description by one skilled in the art, a thickness of about 10–15 mils has been found suitable for an inner shell 40 formed of the materials referenced above. Both outer shell 20 and lid 80 have been found suitable when formed with thicknesses of about 15–20 mils using an oriented polystyrene or blends of oriented polystyrene and high impact polystyrene. The hinge 60 can be formed of the materials and of a thickness of either inner shell 40 or outer shell 20.

While the illustrated embodiment of the present invention has been described as being formed from one or more polymeric materials, those skilled in the art will appreciate that the structural advantages of the present invention may be obtained using other materials such as paper, polycoated paper, glass or ceramic.

From the above description, it will also be appreciated by those skilled in the art that after the container of the present invention has been used, the components may be very easily separated for cleaning and reuse or separate recycling operations. The present invention therefore overcomes the disadvantages inherent in many microwavable containers previously disclosed which utilized different polymers which were coextruded, laminated, or otherwise permanently bonded. The present invention provides the further benefit of an insulating air gap between the outer shell, which must be handled by a consumer, and the inner shell which is in contact with the heated foodstuff.

While illustrated generally in the form of a deep dish tray, the advantages of the present invention may be enjoyed when the container is formed in other shapes including plates, cups, bowls, hinged-lid containers, etc.

Furthermore, in addition to the above described advantages, those skilled in the art will appreciate that the present invention may be formed such that it is less expensive than a container made totally from high temperature resins.

What is claimed is:

1. A microwavable container comprising:

an outer shell comprising a first microwavable polymeric material;

an inner shell comprising a second microwavable polymeric material different from said first microwavable polymeric material; and a flexible connecting means, said flexible connecting means forming a hinge member extending from an outer shelf of said outer shell to an outer shelf of said inner shell, said inner shell rotatably folding about said hinge such that said inner shell is disposed in a substantially spaced relation to said outer shell and is releasably secured to said outer shell.

2. A microwavable container according to claim 1 wherein said outer shell and said inner shell are substantially separated by an air gap.

3. A microwavable container according to claim 2 wherein said inner shell is releasably snap fit into said outer shell.

4. A microwavable container according to claim 1 wherein said hinge member is perforated.

5. A microwavable container according to claim 1 wherein said second microwavable polymeric material has a high-temperature resistance.

6. A microwavable container according to claim 5 wherein said second microwavable polymeric material is selected from the group consisting of polyester, polypropylene, polyphenylene oxide and blends and copolymers thereof.

7. A microwavable container according to claim 6 wherein said first microwavable polymeric material is selected from the group consisting of polystyrene, amorphous polyester, and polyvinylchloride.

8. A microwavable container according to claim 7 wherein said first microwavable polymeric material comprises oriented polystyrene.

9. A microwavable container according to claim 8 wherein said inner shell is releasably snap fit into said outer shell.

10. A microwavable container according to claim 1 wherein said first microwavable polymeric material is selected from the group consisting of polystyrene, amorphous polyester, and polyvinylchloride.

11. A microwavable container according to claim 6 wherein said inner shell is releasably snap fit into said outer shell.

12. A microwavable container according to claim 1 wherein said first microwavable polymeric material comprises oriented polystyrene.

13. A microwavable container according to claim 1 wherein said inner shell is releasably snap fit into said outer shell.

14. A microwavable container comprising:

an outer shell comprising a first microwavable polymeric material;

an inner shell comprising a second microwavable polymeric material different from said first microwavable polymeric material; and a flexible connecting means, said flexible connecting means forming a hinge member extending from an outer shelf of said outer shell to an outer shelf of said inner shell, said inner shell rotatably folding about said hinge;

wherein said inner shell is releasably secured in substantially spaced relation to said outer shell in a manner such that said outer shell and said inner shell are substantially separated by an air gap.

15. A microwavable container according to claim 14 wherein said inner shell is snap fit into said outer shell.

16. A microwavable container according to claim 14 wherein said first microwavable polymeric material is selected from the group consisting of polystyrene, polyvinyl chloride, polyethylene, and blends and copolymers thereof.

17. A microwavable container according to claim 11 wherein said second microwavable polymeric material is selected from the group consisting of polyester, polypropylene, polyphenylene oxide, and blends and copolymers thereof.

18. A microwavable container according to claim 14 wherein said second microwavable polymeric material is selected from the group consisting of polyester, polypropylene, polyphenylene oxide, and blends and copolymers thereof.

19. A microwavable container according to claim 14 wherein said first microwavable polymeric material comprises oriented polystyrene and said second microwavable polymeric material comprises a polymeric material selected from the group consisting of crystallized polyester, polypropylene, polyphenylene oxide and blends and copolymers thereof.

* * * * *